US005375435A

United States Patent [19]

Gille et al.

[11] Patent Number: 5,375,435

[45] Date of Patent: Dec. 27, 1994

[54] PROCESS AND APPARATUS FOR CONTROLLING THREAD FEED IN A WARP KNITTING MACHINE

[75] Inventors: Friedrich Gille, Obertshausen; Georg Kraus, Mömmlingen, both of Germany

[73] Assignee: Karl Mayer Textilmaschinenfabrik GmbH, Obertshausen, Germany

[21] Appl. No.: 138,702

[22] Filed: Oct. 18, 1993

[30] Foreign Application Priority Data

Oct. 17, 1992 [DE] Germany ..... 4235082

[51] Int. Cl.[5] ..... D04B 27/10

[52] U.S. Cl. ..... 66/211; 66/209; 66/210; 364/470

[58] Field of Search ..... 66/203, 204, 205, 210, 66/211, 212; 364/470

[56] References Cited

U.S. PATENT DOCUMENTS

| | | | |
|---|---|---|---|
| 3,727,033 | 4/1973 | Bassist | 66/209 X |
| 3,747,372 | 7/1973 | Nickell et al. | 66/209 |
| 4,031,923 | 6/1977 | van Duynhoven | 66/211 X |
| 4,430,870 | 2/1984 | Winter et al. | 66/203 X |
| 4,605,044 | 8/1986 | Sakano | 66/210 X |
| 5,163,307 | 11/1992 | John et al. | 66/212 |

FOREIGN PATENT DOCUMENTS

| | | | |
|---|---|---|---|
| 234454 | 4/1986 | German Dem. Rep. | 66/210 |
| 3629699 | 3/1988 | Germany . | |
| 1098980 | 6/1984 | U.S.S.R. | 66/211 |
| 1687671 | 10/1991 | U.S.S.R. | 66/210 |

OTHER PUBLICATIONS

German Offical Letter, Dated Oct. 13, 1993.

"Wirkerei-und Strickerei-Technik" 35, (1985), No. 1, pp. 16–19.

*Primary Examiner*—Clifford D. Crowder

*Assistant Examiner*—John J. Calvert

*Attorney, Agent, or Firm*—Omri M. Behr; Matthew J. McDonald

[57] ABSTRACT

A process or apparatus can control thread provision in a warp knitting machine by means of a computer (6). The computer operation involves pattern data (MD) supplied as a sequence of numbers. These numbers are provided to a recognition routine (ER), which for every warp course (line W) determines the lapping type (LA) that should be formed and the shogging distance (SW) prescribed. Tables are stored for providing a thread provision value (FZ) for each combination of lapping type (LA), thread take-off value (WA), and a shogging distance (SW). Based upon (a) the determined lapping type, (b) the inputted fabric take-off value, (c) the input-table external operating parameters or influences, and (d) the determined shogging distance, the thread provision value for this warp course is read out and utilized for controlling thread provision. An arrangement for the control of the thread provision means of a warp knitting machine (1) will comprise (a) a computer (6), a table storage means (13), (b) a program storage means (11) for a programmed recognition routine, (c) an evaluation device (12) for reading out a table (100 through 107), and (d) a control device (5) which by use of the thread provision values read from the tables controls the thread provision.

21 Claims, 4 Drawing Sheets

| WA STICH/cm | SHOGGING DISTENCE SW IN NEEDLE VALUES 1 | 2 | 3 | 4 | 5 | 6 |
|---|---|---|---|---|---|---|
| ... | ... | ... | ... | ... | ... | ... |
| 7 | X | Y | ... | ... | ... | ... |
| 8 | Z | ... | ... | ... | ... | ... |
| 9 | ... | ... | ... | ... | ... | ... |
| 10 | ... | ... | ... | ... | ... | ... |
| ... | ... | ... | ... | ... | ... | ... |

PROCESS AND APPARATUS FOR CONTROLLING THREAD FEED IN A WARP KNITTING MACHINE

BACKGROUND OF THE INVENTION

1. Field of the Invention

The present invention is directed to a process for the control of thread provision in a warp knitting machine comprising a computer to which pattern data and fabric take-off values were provided, and an arrangement for the control of the thread provision means of a warp knitting machine comprising a computer to which pattern data and fabric take-off values are providable.

2. Description of Related Art

Processes and pattern arrangements of the foregoing type are known to the art and are disclosed in Ketenwirk-praxis 2/90, pages 8 and 9. In that system pattern data and fabric take-off values are fed to a computer, which then determines the necessary sequences and thread lengths for each guide bar. The purpose of the present invention is to indicate a means by which the thread provision values may be simply and exactly determined.

In DE-PS 2435312, the warp knitting machine has a pile sinker bar, which is displaceable by one needle space.

SUMMARY OF THE INVENTION

In accordance with the illustrative embodiments demonstrating features and advantages of the present invention, there is provided a process for the control of thread provision in a warp knitting machine having needles on a needle bar and employing a computer. This computer is supplied with (a) a fabric take-off value signifying a predetermined rate of fabric production, and (b) pattern data in the form of a sequence of numbers signifying overlap and underlap displacement of warp courses. The process includes the step of determining for each warp course, which lapping type is to be formed and which shogging distance is prescribed, by a recognition routine responsive to a comparison of at least two sequentially following numbers of the pattern data. The method further includes the step of providing a thread provision value, from at least one predetermined table, for each combination of the lapping type, fabric take-off value, and shogging distance. The method also includes the step of reading off the thread provision value for each warp course to provide a control value for controlling thread provision. Thus thread provision is established on the basis of the determined lapping type, the provided fabric take-off value, and the determined shogging distance.

A related arrangement according to the principles of the same invention, controls a thread provision means of a warp knitting machine. The arrangement has a computer adapted to receive pattern data and fabric take-off values. The computer includes a program storage means, a pattern data storage means, an evaluation means, a table storage means, and a control means. The program storage means can provide a preprogrammed recognition routine for determining from a number sequence, the lapping type and the shogging distance. The pattern data storage means can store the underlap and overlap displacement in a warp course as a number sequence. The pattern data storage means can also in connection with the recognition routine provide signals signifying the lapping type and the shogging distance. The evaluation means can provide a selection signal in response to the fabric take off value and in response to signals from the pattern data storage means signifying lapping type and the shogging distance. The table storage means is responsive to the selection signal of the evaluation means for generating thread provision values, for each combination of lapping type, fabric take-off value, and shogging distance of an examined warp course. The control means is responsive to the thread provision value of the table storage means for controlling the thread provision means.

A preferred process according to these principles uses pattern data (MD), which are provided in the form of numbers. These numbers describe the overlap and underlap displacement of the warp courses. This sequence of numbers is processed by a recognition routine. The routine compares at least two sequentially following numbers, to determine for each warp course (line W), which lapping type (LA) is formed and which shogging distance (SW) is prescribed. The above, stored tables (tables 100 through 107) provide a thread provision value (SZ) for each combination of lapping type (LA), fabric take-off value (WA) and shogging distance (SW). On the basis of the determined lapping type (LA), the provided fabric take-off value (WA) and the determined shogging distance (SW), there is read off the thread provision value (ZW) for each of these warp line (W), which is used for the control of thread provision.

A preferred arrangement for carrying out this process is one wherein the computer comprises a program storage means (11) a pattern data storage means (10), an evaluation circuit (12), a table storage means (13) and a control circuit (5). The program storage means (11) provides a preprogrammed recognition routine, which describes the underlap and overlap displacement in a warp course (line W) to the pattern storage means (10). The pattern storage means (10) determines from the number sequence of the pattern data, the lapping type (LA) and the shogging distance (SW), which are then fed to an evaluation circuit. This circuit is also fed the fabric take off speed (WA) to then produce the selection signal (AS) to the table storage means (13). Table storage means (13) then generates a thread provision value (FZ), for each combination of lapping type (LA), fabric take-off value (WA) and shogging distance (SW) of an examined warp course (line W). This thread provision value (FZ) is fed to control circuit (5) which controls the thread provision means or arrangement (2).

The overlap and underlap displacement determined by a number sequence is not solely integrated in the computation operation, but rather is determined in the framework of the recognition routine, which determines the lapping type and the shogging distance substantially determined by the underlap. For each combination of lap type, shogging distance, and the previously supplied fabric take-off value, there is a position on a table storage means from which the appropriate thread provision value may be read off with great exactness. In this way the correct thread provision value may be correctly determined for each warp course.

The access to the individual tables is very simple in accordance with a procedure wherein for each lapping type (LA) there is stored a table (100 through 107), which for each combination of thread take-off value (WA) and shogging distance (SW) yields a thread provision value (SZ). The appropriate table (100 through 107) is chosen based upon the chosen lapping type (LA). Thus based upon the provided fabric take-off value (WA) and the determined shogging distance (SW), there is read out the appropriate thread provision value (SZ) for the appropriate working course.

In accordance with further embodiments it is possible to distinguish between various lapping types: floating thread, stitch and two needle overlap. In pile forming warp knitting machines, one can also distinguish between the pile lapping type. By utilizing an arrangement wherein the table storage means (11) comprises one table (100 to 107) a particular thread provision value (FZ) can be provided for each lapping type (LA), floating thread, stitch, two needle overlap and, where appropriate pile. With this feature, each combination of fabric take-off value (WA) and shogging distance (SW) provides a particular thread provision value (FZ). Furthermore an evaluation circuit (12) can, based upon the determined lapping type (LA), choose the appropriate table and based thereon reads out from it the appropriate thread provision value (FZ) in dependence upon the inputted fabric take-off value (WA) and the determined shogging distance (SW). This covers practically the entire patterning requirements.

Where a warp knitting machine having pile formation is foreseen, a further embodiment has a recognition routine for first carrying out a pile recognition step. Where the result is negative, the routine determines the nature of the non-pile lap.

The pile recognition calls for a different routine depending on how the pile formation should occur. In the case where the warp knitting machine has a pile sinker bar, which is displaceable by one needle space (as disclosed in DE-PS 2435312), then the procedure is such that the presence of pile in a warp knitting machine having a pile sinker bar displaceable by one needle space, is checked in accordance with number sequence. In particular, the process determines whether, (a) in the previous warp course an overlap larger than null is followed by an underlap different from one needle space, and (b) in the examined warp course, there follows an overlap of one needle space.

On the other hand, if there is utilized a pile sinker bar which is not moveable in the direction of the needle bed, then there is recommended the procedure wherein the presence of pile recognition in a warp knitting machine having pile sinker bar immovable in the direction of the needle bar is checked in accordance with the number sequence. This checking determines whether (a) in the preceding warp course an overlap greater than null is followed by an underlap of at least one needle space, and (b) in the examined warp course there occurs an overlap of one needle, provided that this overlap and the overlap in the preceding warp course are laid over different needles.

In order to determine the pileless lapping type, it is desirable to determine the size of the overlap in the examined warp course. The determination of the shogging distance may be made in a procedure wherein the size of the overlap in the examined warp course is determined in order to the designate the type of non-pile lap.

The shogging distance (SW) in an underlap of one needle space is determined in an underlap of one needle space by reviewing the examined and following warp courses to establish whether the initial value or the end value of the overlaps is smaller, and then calculating the difference between the two smaller values, and in another underlap, by determining the size of the underlap of the examined warp course.

By the use of at least two sets of tables (100 through 103 and 104 through 107) advantages arise. The tables each hold for a particular type of machine, so that with the desired machine type inputted to the computer, the table appropriate for the given machine type and for the specified lapping type (LA) can be chosen.

This makes it possible to take into account different rules for different types of machines; for example: a warp knitting machine or a Raschel machine without pile formation, with elastic pile, with dimension stable pile or toweling, with one or with two guide bars and the like.

The thread provision values (SZ) contained in the tables (100 through 107) may be usefully determined by means of experiments.

It is further desirable to take into account the thread provision values (FZ) contained in the tables (100 through 107), which are adjusted on the basis of external factors which are chargeable to the computer (6). External influences include in particular, a change in the separation of the knock over bar, a change in needle dimensions, a change in the pile finger height, and the like.

It is still further desirable to examine a sequence of lapping values and form an average value by means wherein the thread provision values (FZ) for sequential warp courses (lines W) are summed in a sequence (S1, S2) and their mean values (FZm1, FZm2) are utilized for the control of the actual provision of thread. This gives rise to a quieter run of the warp beam drive, a better survey of the results and the advantage that one may operate with smaller amounts of data whereby the computer usage is reduced.

A highly desirable approach to the combination of thread guiding sequences utilizing a thread provision value storage means is wherein for each repeat (R), the mean value for thread provision (FZm) is determined, after integration of the thread provision values over the warp course formation time. The greatest deviation from the mean value is determined and then a division (T1, T2, T3) is undertaken, so that the thus obtained partial repeats are evaluated in the same way as the repeat, and are themselves divided. This procedure is continued until either a predetermined number of sequences is reached or the deviation of the thread tension bar falls below a predetermined value.

BRIEF DESCRIPTION OF THE DRAWINGS

The invention may be illustrated in greater detail by means of the drawings, summarized as follows.

DETAILED DESCRIPTION OF THE PREFERRED EMBODIMENTS

Figure 1:
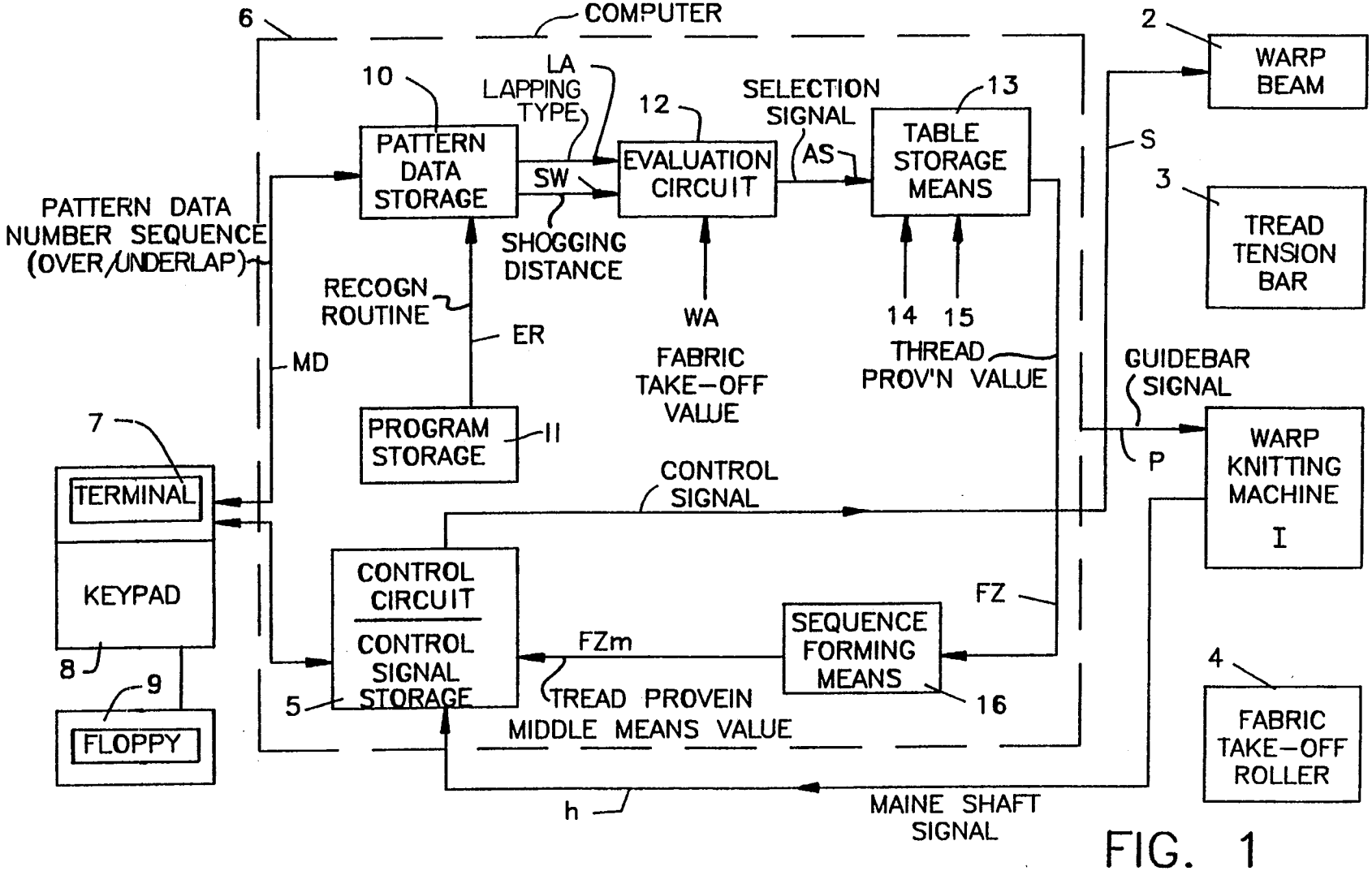
FIG. 1 is a schematic representation of a computer operating in conjunction with a warp knitting machine, in accordance with the principles of the present invention.

FIG. 1 is a schematic representation of a warp knitting machine I utilizing a driven warp beam 2 as the thread provision means or arrangement and having a thread tension bar 3 of conventional construction for smoothing out the differences between the provided thread length and the taken-off thread length, as well as a driven fabric take-off roller 4. The warp knitting machine 1 operates at a predetermined rate of rotation, the fabric take-off roller 4 with an adjustable rate of rotation.

The rate of rotation of the warp beam 2 is determined by a control signal S which is called out from a control circuit 5 of the machine computer 6 in dependence on the rate of rotation of the main shaft of the warp knitting machine 1, as indicated by the generated rotation signal "h." This computer 6 also controls the other functions of the warp knitting machine 1, for example the guide bar displacement, which is illustrated by signal "p." Computer 6 may be a microcomputer, or a more general purpose computer. The computer 6 comprises, in the usual manner, a terminal 7, a keypad 8 and a floppy disk arrangement 9.

In the present case, computer 6 is also used to independently generate the thread provision values FZ, utilized to form the control signal "S". It will be understood that the illustrated sections of computer 6 may be considered portions of the internal programming, separate memory sections, programmable logic arrays, or in some embodiments separate systems having independent computers or other control circuitry. In any event, the pattern data number sequence MD, which describes the overlap and underlap displacement in the warp lines, is transmitted to the pattern data storage means 10 via keypad 8. In the simplest case, the number sequence comprises the height of the pattern chain links or their equivalents, which describe the positions of the guides during swinging and swinging out.

The keypad may further be utilized to input which machine type is utilized, i.e. a tricot or Raschel machine, single bar or double bar with or without pile and type of pile formation.

To the pattern data storage means 10 is provided a program storage means 11, which supplies a recognition routine ER, which examines the stored pattern data, line by line, with respect to its lapping type LA and its shogging distance SW. The thus determined properties are provided to an evaluation means (circuit 12), which has further input means through which the fabric take-off value WA of the fabric take-off roller 4 may be provided. Based upon the three input data, the evaluating circuit 12 reads out a selection signal AS, which selects a particular thread provision value FZ for each warp course, from table storage means 13.

The table values can be determined by test experiments and can be corrected based upon outside influences such as needle thickness, separation of the knock-over bars and the like, via input means 14 and 15.

The thread provision values FZ, which are read out of the table storage means 13 for each warp course are provided to a sequence forming means 16, which combines the thread provision values FZ of a particular repeat in a limited number of sequences. From each of these, there is calculated a thread provision middle mean value FZm, which is transmitted to the control circuit 5, from which the control signal S can then be transmitted to the drive of the warp beam 2.

For archival purposes, the pattern data in the pattern data storage means 10 and the thread provision values FZm, from the control means (circuit 5), can be transferred to a floppy disk, in disk input/output means 9, so that a single determination of the thread input values suffices. Per contra, it is possible to determine the required values for thread provision FZm from the pattern data MD on another computer (for example the patterning computer) and by means of a floppy disk, input these via input/output means 9, so that the control signals "p" and "s" are predetermined.

Figures 2, 3:
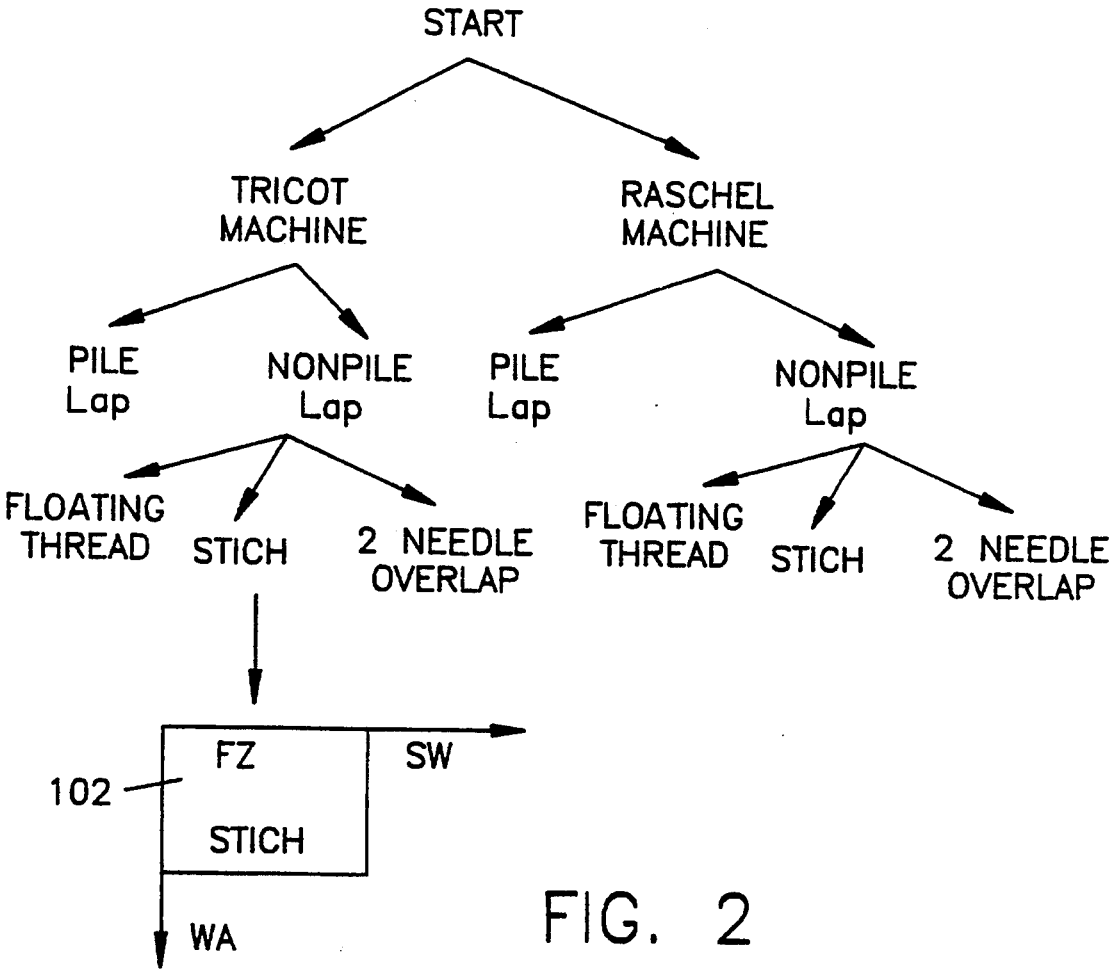
FIG. 2 is flowchart embodying a programmed recognition routine.
FIG. 3 is a tabular representation from FIG. 2, showing the thread provision amounts in dependence upon the fabric take-off value and the shogging distance.

FIG. 2 shows a possible recognition routine. After the start, the machine type is differentiated by input via the keypad 8. Thereafter, for each machine type there is automatic differentiation between pile laps and non-pile laps. Where the lapping is non-pile, there is further differentiation between floating thread, stitch, and two needle overlap. In dependence upon the thus determined lapping, a particular table is chosen, wherein the thread provision value FZ is stored as a function of the fabric take-off value WA and the shogging distance SW. Since the shogging distance is determined in the recognition routine and the fabric take-off value is preset, it is possible to read out a very particular thread provision value for the appropriate warp course.

This is further illustrated in FIG. 3. The shogging distance SW is shown in needle values; that is to say, a multiple of needle spaces. The fabric take-off value WA is shown in stitches per centimeter. The values x, y and z represent the thread provision values.

Figure 4:
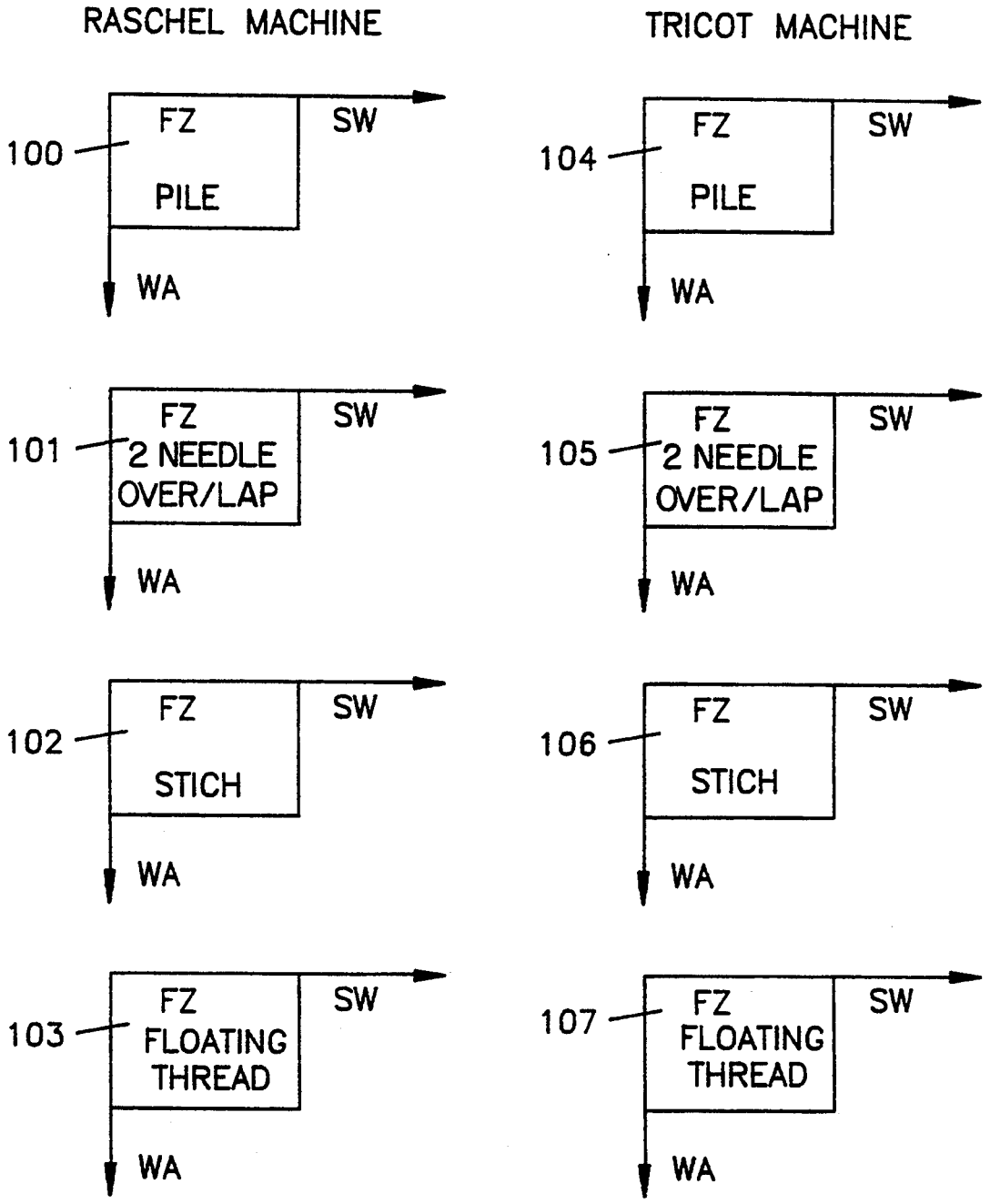
FIG. 4 shows eight tables in the manner in which they are provided in FIG. 2.

In FIG. 4 eight tables are shown which correspond to the situations illustrated in FIG. 2. In actual practice such tables may be provided for each and every machine type.

There follow two examples for the automatic determination of the thread provision values.

EXAMPLE A

As machine type there is provided a tricot machine with a pile sinker bar, which is displaced in each working cycle during the underlap by one needle space. The repeat covers six warp lines. The fineness of the machine is 28 needles per inch, the pile finger height is 2 millimeters and the fabric take-off rate is 20 millimeters per rack.

Initially, the machine operator inputs the machine type and the pattern data MD for each warp course of the lapping pattern. This is done by means of a number sequence which corresponds to the conventional warp chain link height notation. This generates the following table.

TABLE 1

| Line | Lap | Pile Recognition | Non-Pile Lap | Shogging Distance | FZ Value |
|---|---|---|---|---|---|
| 1 | 1 | Pile | | 1 | 4035 |
| | 0 | | | | |
| 2 | 1 | | Stitch | 0 | 1140 |
| | 2 | | | | |
| 3 | 1 | | Floating | 0 | 290 |
| | 1 | | Thread | | |
| 4 | 1 | | Floating | 0 | 290 |
| | 1 | | Thread | | |
| 5 | 1 | | Stich | 0 | 1140 |
| | 0 | | | | |
| 6 | 0 | Pile | | 0 | 3600 |

TABLE 1-continued

| Line | Lap | Pile Recognition | Non-Pile Lap | Shogging Distance | FZ Value |
|---|---|---|---|---|---|
| | 1 | | | | |

In such a lapping the first line is an overlap of 1 after 0, followed by an underlap of 0 upon 1. In the second line the overlap goes from 1 after 2 and the underlap from 2 upon 1; and thus correspondingly for the further lines.

For the machine type under consideration the pile recognition operates as follows: When in line n, there occurs an overlap over at least one needle with a sequential underlap of 0,2,3 etc., needle spaces and in line n+1 an overlap over one needle, then the line n+1 is a pile line, since the pile sinker displaced by one needle space grabs the appropriate thread. Thus, in lines 1, and 6 the pile will be recognized.

Subsequently, all non-pile lines will be examined with respect to their lapping. Herein the overlap is always determinative. An overlap of 0 corresponds to a floating thread. An overlap of 1 to a stitch and an overlap of 2 to a two needle overlap.

Furthermore, each line has an appropriate shogging distance which is substantially dependent upon the underlap. Where the underlap, as in the previous example basically has a value of 1, then in each line (the line under examination and the one following) the lower of the two numbers controls and from these the absolute value of the difference is formed. This is the shogging distance as it is set forth in the penultimate column of the table. For an underlap different from one it is sufficient to utilize the underlap following the underlap under examination as the shogging distance, as is illustrated in the following example.

Since the lapping type is now known for each line the appropriate table can be called out of the table storage means and from it, in dependence upon the determined shogging distance and the preset fabric take-off value WA, the appropriate thread provision value FZ can be read out. From the final column it may be seen that the thread consumption varies considerably. Where the thread floats, a comparatively small thread provision value will suffice. Whereas, where there is pile with a shogging distance of 1, the consumption is 14 fold higher, the other provision values lie there between.

EXAMPLE B

In this example there is utilized a tricot machine for formation of a dimensionally stable pile. In this case the pile sinkers are not moved in the direction of the needle bed. The fineness of the machine is again 28E and the pile finger height 2 millimeters. The fabric take-off rate is 20 millimeters per rack. This gives rise to the following table, when the operator inputs the number sequence for the lapping pattern.

TABLE 2

| Line | Lap | Pile Recognition | Non-Pile Lap | Shogging Distance | FZ Value |
|---|---|---|---|---|---|
| 1 | 1<br>0 | | Stitch | 0 | 1140 |
| 2 | 0<br>1 | | Stitch | 5 | 2860 |
| 3 | 6<br>7 | Pile | | 0 | 3600 |
| 4 | 7<br>8 | | Stitch | 7 | 3680 |

TABLE 2-continued

| Line | Lap | Pile Recognition | Non-Pile Lap | Shogging Distance | FZ Value |
|---|---|---|---|---|---|
| 5 | 1<br>0 | Pile | | 0 | 3600 |
| 6 | 1<br>0 | | Stitch | 1 | 1240 |
| 7 | 1<br>2 | Pile | | 1 | 4035 |
| 8 | 1<br>0 | Pile | | 1 | 4035 |
| 9 | 1<br>2 | Pile | | 1 | 4035 |
| 10 | 1<br>0 | Pile | | 1 | 4035 |

In the pile recognition one can thus follow the following rule of pattern. Where there appears (a) in line n a desired overlap greater than null with a subsequent underlap of at least one needle, and (b) in line n+1 an overlap with respect to one needle, then line n+1 is a pile line, unless the overlaps in rows n and n+1 proceed over the same needle. This occurs because under these conditions the threads are grasped by the pile sinkers. Thus, lines 3, 5, 7, 8, 9 and 10 will be pile lines.

The recognition of non-pile lines is similar to that in the first example. In this case it can be found that in lines 1, 2, 4 and 6 there is an overlap over 1 needle, which corresponds to a stitch lap.

The shogging distance for underlaps of 1 are determined in the same manner as in the previous example. In all the remaining underlaps, that is to say, 0, 2, 3, etc., the size of the underlap is utilized as the shogging distance.

This lays down the corresponding table from which the thread provision value Z may be determined in dependence upon the shogging distance SW and the fabric take-off value WA.

Figure 5:
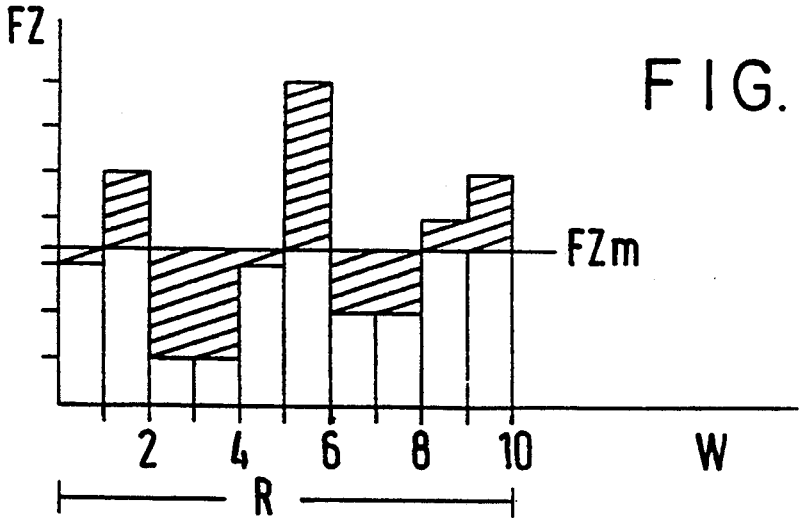
FIG. 5 shows the individual thread provision values (FZ) in millimeters/rack for individual warp courses (lines W).

In FIG. 5, there is illustrated the thread provision value FZ in the dimension of millimeters per rack over the warp line number W and thus, set forth in the process over time. This gives rise to a very uneven process. It is however possible to determine the mean thread provision value SZM for the entire repeat. In practice however, this is not useful since the deviations of the actual thread provision values from the means values are so great that damage to the threads either by excess tension, or insufficient tension, i.e. slack, are to be found.

Figure 6:
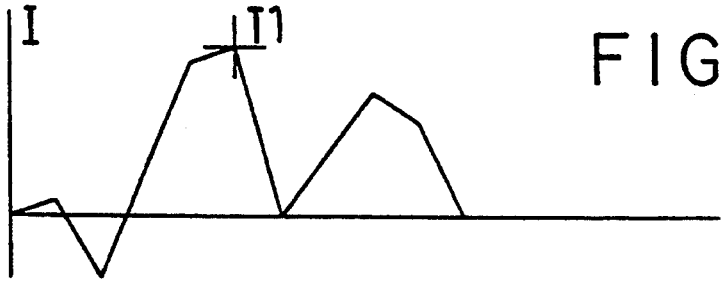
FIG. 6 is an integral function for the determination of the transition point between mutually following sequences.
Figure 7:
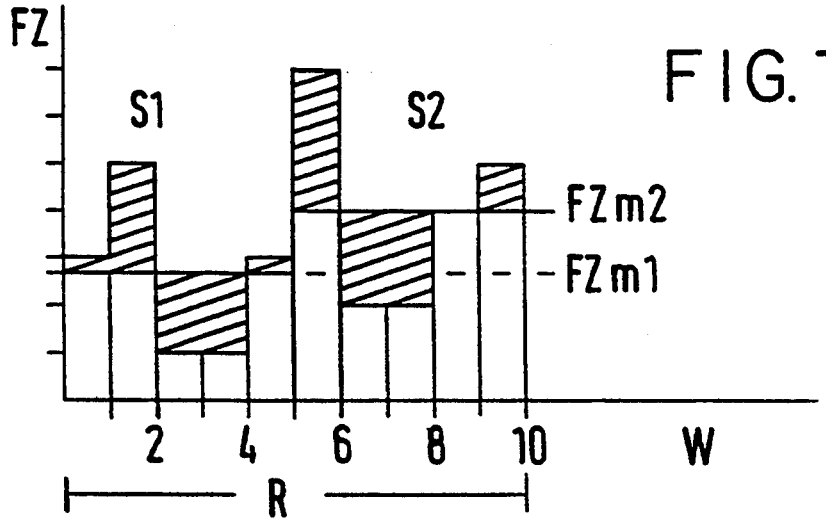
FIG. 7 is a diagram similar to FIG. 5 with altered mean values for the thread provision values.

This can be recognized from FIG. 6, which represents the integral I of the thread provision value over the warp line number W, i.e. effectively over time. As the integral function I the mean thread provision value FZm is shown relative to the actual thread provision value FZ. The corresponds to the deviation of the thread tension bar 3 from its middle position. The greatest deviation occurs at point T1. If we divide the repeat R at this point into two sequences S1 and S2, we obtain the situation set forth in FIG. 7.

Figure 8:
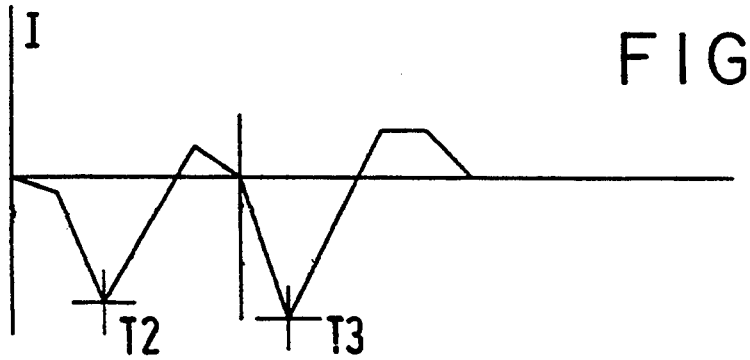
FIG. 8 is an integral function like FIG. 6.

We can now consider the appropriate mean value for each sequence and generate the mean thread provision values FZm1 and FZm2. This generates the integral function I, which is illustrated in FIG. 8 which shows different deviations from the mean thread input values. At the points of greatest deviation, i.e. T2 and T3 we can again make a division so that in toto there are four sequences within which a mean thread input value may be determined which, is determinative for the drive of the appropriate warp beam.

With a tension bar of with a sufficiently large capacity, one can carry out these steps until a predetermined but not too great a sequence number is obtained. With respect to the predetermined capacity of the thread tension bar, the division must continue until the maximal deviation of the thread storage is evened out.

In order to determine in how many sequences with different mean thread provision values FZm, a repeat must be divided, there are two conditions to be fulfilled:

a) The thread provision should not be altered for every work cycle. In this manner, one can avoid undesired acceleration and delays with the warp beam drive.

b) The difference between the actual thread provision value FZ and the appropriate mean thread provision value FZm of the appropriate sequence, must be smaller than the capacity of the thread storage means, i.e. the usual thread tension bar.

From the illustrated examples several embodiments may be considered without deviating from the central idea of the invention. For example, the machine type need not be entered via a keyboard 8, but the table storage means 13 may be utilized as a conversion storage means which is charged with the tables of a particular machine type, similarly this can occur via disk. There is also the possibility of providing the tables in a different manner for example, in such a way that for each fabric take-off value there is foreseen a table from which the thread take-off value may be read out in conjunction with the shogging distance and the lapping type.

We claim:

1. Process for the control of thread provision in a warp knitting machine having needles on a needle bar and employing a computer, said computer being supplied with (a) a fabric take-off value signifying a predetermined rate of fabric production, and (b) pattern data in the form of a sequence of numbers signifying overlap and underlap displacement of warp courses, said process comprising the steps of:

determining for each warp course, which lapping type is to be formed and which shogging distance is prescribed, by a recognition routine responsive to a comparison of at least two sequentially following numbers of said pattern data;

providing a thread provision value, from at least one predetermined table, for each combination of the lapping type, fabric take-off value, and shogging distance; and reading off the thread provision value for each warp course to provide a control value for controlling thread provision, and controlling the thread feed rate established on the basis of the determined lapping type, the provided fabric take-off value, and the determined shogging distance.

2. Process in accordance with claim 1 wherein the step of providing a thread provision value is performed with said at least one predetermined table having a plurality of specific tables, one for each lapping type, each of said specific tables yielding said thread provision value for each combination of thread take-off value and shogging distance, and including the step of:

chosing said one of said specific tables based on lapping type, said thread provision value being read out from the chosen one of said specific tables for each warp course based upon the fabric take-off value provided and the shogging distance determined.

3. Process in accordance with claim 2 wherein the step of determining lapping type with the recognition routine is performed by distinguishing between a plurality of lapping types including: (a) floating thread, (b) stitch, and (c) two needle overlap.

4. Process in accordance with claim 3 wherein the step of determining lapping type with the recognition routine in pile forming warp knitting machines, is performed by distinguishing between pile lapping type.

5. Process in accordance with claim 1 wherein the recognition routine is performed by:

first recognizing if the pattern data signifies a pile lap; and if a pile lap is not signified, determining the nature of the non-pile lap.

6. Process in accordance with claim 3 wherein the recognition routine is performed by:

first recognizing if the pattern data signifies a pile lap; and if a pile lap is not signified, determining the nature of the non-pile lap.

7. Process in accordance with claim 6 and performed with a warp knitting machine having a pile sinker bar displaceable by one needle space, wherein the step of recognizing a pile lap from the sequence of numbers of said pattern data, is performed by:

determining from the pattern data whether (a) for a warp course prior to an examined course, an overlap larger than null is followed by an underlap different than one needle space, and (b) the examined warp course has an overlap of one needle space.

8. Process in accordance with claim 6 and performed with a warp knitting machine having a pile sinker bar immovable in the direction of the needle bar, wherein the step of recognizing a pile lap from the sequence of numbers of said pattern data, is performed by:

determining from the pattern data whether (a) in a warp course prior to an examined warp course, an overlap greater than null is followed by an underlap of at least one needle space, and (b) the examined warp course has an overlap of one needle, provided that in the examined and the prior warp courses, overlaps are laid over different needles.

9. Process in accordance with claim 6 wherein the step of determining the nature of the non-pile lap is performed by:

determining size, from the pattern data, for an overlap in a warp course under examination, in order to the classify a non-pile lap.

10. Process in accordance with claim 1, wherein the pattern data associates a pair of numbers with each overlap and wherein shogging distance is determined from the pattern data:

(a) if an underlap of one needle space follows an overlap under examination, by calculating a difference using the smaller number associated with an overlap under examination and the smaller number associated with a following overlap, and (b) if an underlap other than one needle space follows the overlap under examination, by determining the size of the underlap following the overlap under examination.

11. Process in accordance with claim 9, wherein the pattern data associates a pair of numbers with each overlap and wherein shogging distance is determined from the pattern data:

(a) if an underlap of one needle space follows an overlap under examination, by calculating a difference using the smaller number associated with an overlap under examination and the smaller number associated with a following overlap, and (b) if an underlap other than one needle space follows the overlap under examination, by determining the size of the underlap following the overlap under examination.

12. Process in accordance with any of claim 11 wherein the step of providing a thread provision value is performed with said at least one predetermined table having a plurality of dedicated tables, including at least one for each of two types of warp knitting machines, comprising the steps of:

communicating machine type information to the computer; and chosing said one of said dedicated tables based on the machine type data communicated to said computer.

13. Process in accordance with claims 12 wherein the step of chosing one of said dedicated tables is based on lapping type and on the machine type data communicated to said computer.

14. Process in accordance with claim 12 wherein the thread provision values contained in said predetermined table are determined by means of test experiments.

15. Process in accordance with claim 14 comprising the step of:

adjusting the thread provision values contained in said predetermined table on the basis of external operating parameters of said warp knitting machine that are loaded into the computer.

16. Process in accordance with claim 1 wherein the thread provision values for sequential warp courses are summed in a sequence and their mean values are utilized for the control of the actual provision of thread.

17. Process in accordance with claim 15 wherein the thread provision values for sequential warp courses are summed in a sequence and their mean values are utilized for the control of the actual provision of thread.

18. Process in accordance with claim 17 wherein the pattern data represents a repeat, the process comprising the steps of:

calculating a mean value for thread provision value, after integration of the thread provision values derived over the repeat;

finding maximum deviation from the mean value; and dividing the repeat into at least two partial repeats having a border determined by the maximum deviation from the mean value.

19. Process in accordance with claim 18 comprising the steps of:

evaluating and dividing the partial repeats into successively smaller partial repeats in the same way as the repeat was evaluated and divided; and repeating the procedure of evaluating and dividing successively smaller partial repeats until either a predetermined number of partial repeats is reached or the deviation from mean of the thread provision value for each partial repeat is less than a predetermined value.

20. Arrangement for control of a thread provision means of a warp knitting machine, comprising:

a computer adapted to receive pattern data and fabric take-off values, said computer comprising:

a program storage means for providing a preprogrammed recognition routine for determining from a number sequence, the lapping type and the shogging distance;

a pattern data storage means for storing the underlap and overlap displacement in a warp course as a number sequence, said pattern data storage means being operable in connection with said recognition routine to provide signals signifying the lapping type and the shogging distance;

an evaluation means for providing a selection signal in response to the fabric take off value and in response to signals from said pattern data storage means signifying lapping type and the shogging distance;

a table storage means responsive to said selection signal of said evaluation circuit for generating thread provision values, for each combination of lapping type, fabric take-off value, and shogging distance of an examined warp course; and a control means responsive to said thread provision value of said table storage means for controlling the thread feed rate of the thread provision means.

21. Arrangement in accordance with claim 20 wherein the table storage means comprises:

a plurality of tables, at least one for each lapping type, including (a) floating thread, (b) stitch, and (c) two needle overlap, each of said tables for each combination of the fabric take-off value and the shogging distance, providing a particular one of said thread provision values, said evaluation circuit in response to the lapping type selecting the appropriate one of said tables, said table storage means providing from said appropriate one of said tables the thread provision value in dependence upon the fabric take-off value supplied to said computer and the shogging distance.

* * * * *